US008167134B2

(12) United States Patent
Helmy

(10) Patent No.: US 8,167,134 B2
(45) Date of Patent: May 1, 2012

(54) SIFTING SCREEN STRUCTURE

(75) Inventor: Nashat N. Helmy, West Bloomington, MN (US)

(73) Assignee: Tandem Products, Inc., Minneapolis, MN (US)

( * ) Notice: Subject to any disclaimer, the term of this patent is extended or adjusted under 35 U.S.C. 154(b) by 490 days.

(21) Appl. No.: 12/197,753

(22) Filed: Aug. 25, 2008

(65) Prior Publication Data

US 2009/0071879 A1 Mar. 19, 2009

Related U.S. Application Data

(63) Continuation-in-part of application No. 11/772,612, filed on Jul. 2, 2007.

(60) Provisional application No. 60/806,389, filed on Jun. 30, 2006, provisional application No. 60/822,336, filed on Aug. 14, 2006.

(51) Int. Cl.
*B07B 1/46* (2006.01)

(52) U.S. Cl. ..... 209/401; 209/400; 209/403

(58) Field of Classification Search ..... 209/392–384, 209/397, 399, 400, 401, 403
See application file for complete search history.

(56) References Cited

U.S. PATENT DOCUMENTS

| | | | | |
|---|---|---|---|---|
| 1,718,385 | A * | 6/1929 | Sherwood | 209/397 |
| 3,194,397 | A | 7/1965 | Taeg | |
| 3,664,503 | A * | 5/1972 | Felden | 209/397 |
| 3,811,570 | A * | 5/1974 | Holding et al. | 209/399 |
| 3,833,120 | A | 9/1974 | Ogata | |
| 3,972,974 | A * | 8/1976 | Pico | 264/267 |
| 3,980,555 | A | 9/1976 | Freissle | |
| 4,120,785 | A | 10/1978 | Kanamori et al. | |
| 4,374,169 | A * | 2/1983 | Gryskiewicz et al. | 428/221 |
| 4,563,270 | A * | 1/1986 | Wolff | 209/379 |
| 4,674,251 | A * | 6/1987 | Wolff | 52/309.15 |
| 4,728,422 | A * | 3/1988 | Bailey | 210/314 |
| 5,735,409 | A | 4/1998 | Malmberg | |
| 7,303,079 | B2 | 12/2007 | Reid-Robertson et al. | |
| 7,682,996 | B2 * | 3/2010 | Carr | 442/229 |
| 7,757,864 | B2 * | 7/2010 | Barrett et al. | 209/274 |
| 7,810,649 | B2 * | 10/2010 | Robertson | 209/401 |
| 2008/0067113 | A1 * | 3/2008 | Helmy | 209/405 |

* cited by examiner

*Primary Examiner* — Joseph C Rodriguez
(74) *Attorney, Agent, or Firm* — Nawrocki, Rooney & Sivertson, P.A.

(57) ABSTRACT

A mesh panel of the type having a plurality of spaced apart apertures includes an internal frame member substantially in the form of a perforated sheet, and having a plurality of openings therein larger than the apertures. The frame member has substantial internal rigidity. An elastomeric coating encapsulates at least a portion of said frame member. In a preferred embodiment, a bonding coating between the elastomeric coating and the frame member securely bonds to both the elastomeric coating and the frame member. The bonding coating is of the type that is liquid before application to the frame member and is curable by heat or time to a hard plastic. Preferably, the bonding coating is partially cured before the elastomeric coating is applied, after which both coatings are cured by heat. The panel is particularly well suited for use as a sorting screen.

15 Claims, 4 Drawing Sheets

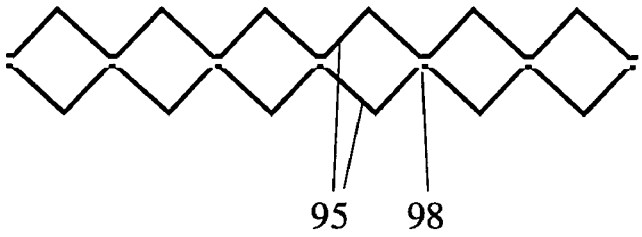
FIG. 4
FIG. 5
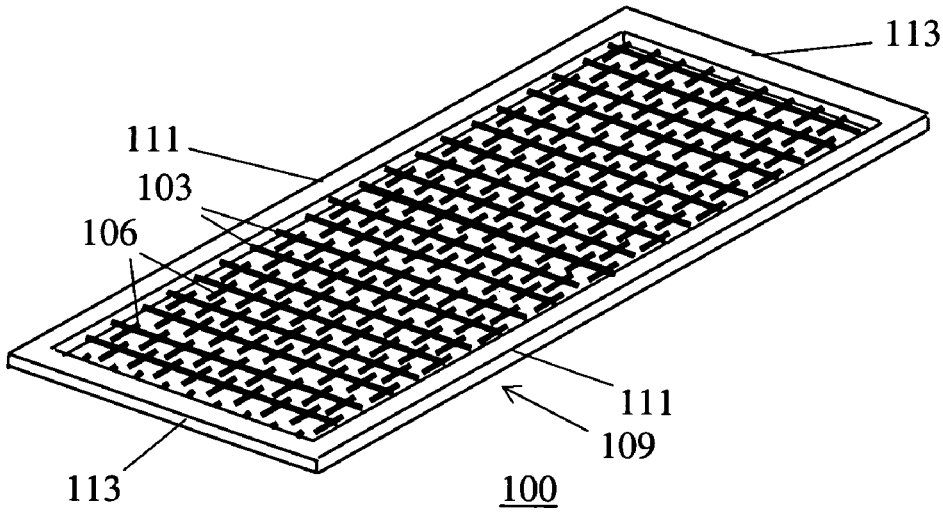

SIFTING SCREEN STRUCTURE

CROSS-REFERENCE TO RELATED APPLICATIONS

This is a continuation-in-part filed under 35 U.S.C. §111(a) claiming priority, under 35 U.S.C. §119(e)(1), of provisional application Ser. No. 60/806,389, previously filed Jun. 30, 2006 under 35 U.S.C. §111(b), and of provisional application Ser. No. 60/822,336, previously filed Aug. 14, 2006 under 35 U.S.C. §111(b), and regular utility application Ser. No. 11/772,612, previously filed Jul. 2, 2007 under 35 U.S.C. §111(a).

TECHNICAL FIELD

The present invention deals with mesh panels or sheets having a relatively large number of perforations therein. These panels are particularly useful as screens or sieves for sifting or sorting a mass of particles of various sizes, but, when made of appropriate materials and with appropriate dimensions, may also have utility as perforated floor or wall panels. The invention allows manufacture of the panels to close tolerances and with good resistance to abrasion and wear.

Stones for use as aggregate in concrete are often sorted according to size, since particular applications of concrete require aggregate of a specified size range. Such sorting equipment requires processing large amounts of abrasive materials. The screens in the sorting equipment that sort the particles (stones) into groups of similar sizes are subject to continuous abrasion and impact.

The term "panel" herein means a sheet-like or plate-like structure having one dimension (thickness) that is relatively small compared to the size of the other two dimensions of the panel. A plywood sheet is an example of a panel.

BACKGROUND OF THE INVENTION

The prior art has a number of different types of designs for panels used as screens for sifting aggregate and other particulate matter according to particle size. For example, a woven wire panel in the form of a grid or matrix comprises one type of screen panel available. Such a woven wire matrix is stretched over a bucker bar support arrangement to hold the screen under significant tension.

Another type of screen known in the art is one typically comprising multiple abutting modules made of, or coated with, elastomeric material. Such modules are typically plates or molded panels with a plurality of perforations and made of a material such as rubber or polyurethane.

Both of these types of screen designs have significant drawbacks when evaluated according to a number of accepted criteria. First, the size and configuration of the openings or perforations through which smaller particles of the material are to pass is a significant factor if particles jam or clog the openings.

An undesirable situation may arise if excessive clogging of any one of a plurality of sifting or sieving panels occurs because of the configuration of the openings or perforations. In such a case, the operator must suspend sifting operations until the clogging is rectified. In accomplishing this with respect to one of multiple sifting decks, removal of other decks may be necessary. During such a cleaning operation, the entire process of use of the sieving equipment halts. This may be costly.

A second factor to be considered is durability or longevity. Because of the highly abrasive environment in which sifting screens typically operate, deterioration can be quite rapid. Not only does this involve increased cost incident to replacement, but downtime can occasion significant costs.

A third factor is the cost of the screens. Wire mesh screens are relatively inexpensive, but they tend to wear rapidly, particularly when the material undergoing sifting or sieving is abrasive. Sand and gravel are examples of such materials. The rapid wear requires frequent replacement and consequent down time.

On the other hand, polyurethane or rubber screens are perhaps 10-12 times more expensive than wire mesh, but they tend to wear perhaps 10 times as long. An operator of a sieving apparatus must, therefore, balance the high initial cost and high durability of polyurethane or rubber screens against the low cost and durability of wire mesh screens.

The operator must consider the total economic cost. For example, wire might be relatively inexpensive per lineal foot. One must, however, consider other costs. Mere replacement cost, while important, is not the end of the analysis. An operator of such apparatus must consider the cost of more frequent screen replacement. For example, a relatively inexpensive screen with low durability that must be replaced ten times as often as another more expensive construction may in the long run, be either less or more costly than the more expensive structure depending on the difficulty in reaching and repairing or replacing a damaged screen or segment thereof.

When applying these factors to prior art structures, one concludes that a woven wire structure is excellent in terms of open area. In terms of durability or longevity, however, woven wire tends to be very poor. And, while in terms of mere price of the material comprising the screen wire tends to be the least expensive, in terms of total economic realities, it must be replaced frequently and overall economic cost can be significant. As will be able to be seen then, there are many costs that must be borne if one chooses to use a woven wire screen.

In terms of open area, a punched or molded screen made of, or coated with, polyurethane, rubber or another elastomer also leaves something to be desired. In the molding or punching process, there can be burrs that, to one degree or another, can partially occlude the apertures through which passes the particles being processed. Further, while a screen made of such materials is typically quite durable, it is very expensive. In a total economic sense, therefore, such screens may not be desirable.

The art of the design of sifting screens reveals no type of screen that does not have some types of shortcomings. While some of the factors generate good marks with regard to a particular type of screen, such a screen is deficient in other respects making it, in many instances, economically disadvantageous.

The present invention is a screen designed for use in sifting, sizing and classifying sieves which solves problems of the prior art. It is of a unique construction which offers a proposed solution to problems of the prior art.

SUMMARY OF THE INVENTION

The present invention is a panel or screen with a large number of perforations or openings suitable for sorting a mass of solid particles of different sizes into particles grouped according to size, and a process for forming the panel.

The panel has at least two, and preferably three distinct components. There is an inner frame member typically made of metal (ferrous) wires, rods, or strands having a specific spacing between adjacent strands, or alternatively, a hard plastic. The frame member may comprise for example, interwoven metal wires or strands, or a series of spaced, substantially parallel rods supported by a pair of elongate members. The frame member has specific dimensions and tolerances to provide the intended end use. Preferably, a metal frame member is initially prepared by priming with a primer that softens without permanent damage when heated to over 300° F.

In a preferred embodiment, the panel includes a hard plastic middle layer that strongly adheres to the primer on the frame member. Finally, an elastomeric outer layer made of a flexible and resilient rubber or polyurethane elastomeric material encapsulates the frame member, and if present, the hard plastic middle layer. The elastomeric material bonds firmly to the surface beneath it.

Preferably, the elastomeric outer layer is formed by a molding process. The frame member is placed in a mold whose pattern defines the apertures. The mold with the frame member in it is then filled with heat-curable elastomeric material, and the entire assembly is heated to completely cure both the middle layer when present and the elastomeric layer. The outer layer completes intersecting bars or segments that define individual openings of the screen or panel.

When present, the middle layer is preferably made of a hard plastic that covers the frame. Either spraying or dipping may form the middle layer. This plastic is preferably a hard, high durometer synthetic material that when properly treated, adheres well to both the frame member and the elastomeric outer layer.

A preferred process allows a middle layer when present, to provide superior adhesion between the frame member and the elastomeric layer. The frame member is heated to a suitable temperature and then the heated frame member is dipped in a liquid plastic or liquid polymer to create a middle layer or coating on the frame member comprising a viscous coat of the plastic or polymer that adheres to the frame member. If necessary to congeal the middle layer to a point that permits further handling during the process, the coated frame member may be placed in a heated chamber to partially cure the middle layer. This partial curing allows the coating to retain its ability to adhere to both the primer on the metal frame member and to the elastomeric outer layer, and to retain consistent thickness.

In this preferred process, the frame is first heated to between 350° F. and 650° F. Then liquid polymer at a temperature of between 80° F. and 120° F. applied to the frame forms a coat of polymer on the frame. After coating the frame, the two-component matrix is held to a temperature in the range of approximately 120-220° F. The liquid polymer layer must have a jelling stage and be able to maintain a jelled consistency without completely reacting and curing before introducing the polymeric elastomeric outer layer to the matrix. After the outer polymeric elastomeric layer is formed on the frame and middle layer, and the entire assembly is heated, a reaction takes place at the interface between the middle jelling layer and the outer layer. This reaction forms a strong bond between the middle and outer layers.

In one version of the screen, the shape of the outer layer forming each bar of the screen may be trapezoidal to provide angled side walls for each opening which give the openings a trapezoidal shape in at least one direction. Other versions may also provide for triangular, square, or rectangular cross-sections of the outer layers. This can be accomplished by direct formation of each strand including a frame section using mechanical means, such as molding, drawing through a special die, or by physically rotating the entire matrix at a certain speed while applying an air flow current in a direction to provide formation of a tapered wall. The preferred method is to employ mechanical means such as a special molding implement or a special forming die to provide a triangular or trapezoidal shape.

The entire process of making the webbing by weaving or welding a frame portion, adding the middle layer and encapsulating the entire matrix should result in a screen opening with a tolerance of ±0.001" so that the entire jelled matrix has openings with a trapezoidal cross section, and with each screen opening having a tolerance less than 0.003".

For finishing, the panel, comprising all layers, is cured on a mount to allow the coating materials to completely react and fuse without altering the opening size or the opening tolerance. Finally, the entire cured panel is cooled while maintaining its integrity and the tolerances of all the openings.

A particular construction according to this invention comprises an internal mesh or screen panel of the type having a plurality of spaced apart apertures, and forming a frame member substantially in the form of a sheet. The frame member has a plurality of openings, typically similarly sized, that are larger than the desired apertures but have identical center to center spacing. The frame member has substantial internal rigidity. "Substantial internal rigidity" means that the frame member comprises components fixed with respect to each other in the plane or other surface of the frame member, but the frame member itself is bendable from its unloaded shape with application of adequate bending moment.

An elastomeric layer encapsulates at least a portion of said frame member securely bonds thereto. Preferably, this secure bonding arises from the presence of a middle bonding layer between the elastomeric layer and the frame member securely bonds to both the frame member and the elastomeric layer. However, the bonding coating is not absolutely necessary, if the elastomeric layer bonds with adequate strength to the frame member.

DESCRIPTION OF THE DRAWINGS

FIG. 4 shows a first alternative construction for the panel.

FIG. 5 shows a second alternative construction for the panel.

DETAILED DESCRIPTION OF THE INVENTION

Figure 1:
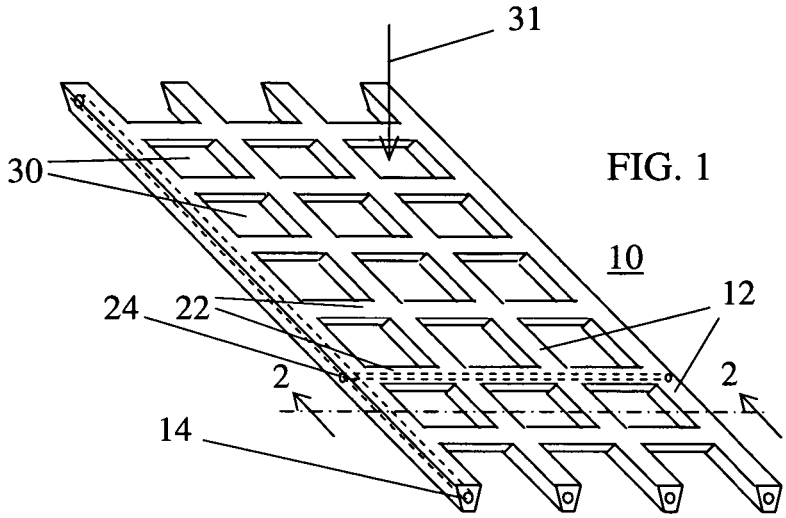
FIG. 1 is a perspective view of a representative mesh or grid panel for convenience showing fewer apertures than a commercial version.
Figure 2:
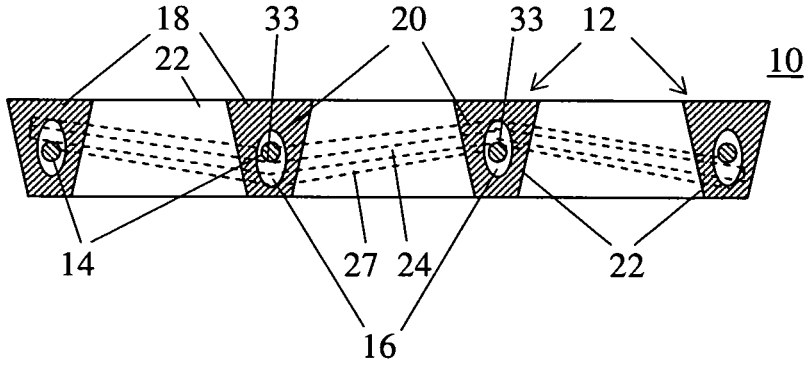
FIG. 2 is a section view illustrating the internal construction of the panel of FIG. 1.

FIGS. 1 and 2 together illustrate a first preferred embodiment of the invention. Like reference numbers denote like elements. The embodiment of the invention shown in FIGS. 1 and 2 is a panel 10 with a plurality of apertures useful as a screen or mesh for sorting a mass of different sizes of particles.

The panel 10 shown in FIG. 1 illustrates the grid-like construction of a screen mesh in accordance with the present invention. For simplicity in illustrating the invention, the panel 10 shown in FIG. 1 has many fewer apertures 30 than is typical for a sorting screen. A commercially suitable panel 10 may be perhaps 2 ft. by 4 ft. or larger, with apertures 30 that are from 0.1 in. square to 1.0 in. square or even larger. That is, a typical panel 10 designed for sorting particulate matter will comprise a grid having perhaps hundreds of apertures 30 rather than the 15 apertures 30 shown in FIG. 1.

A typical panel 10 provides substantial resistance to bending, but with sufficient force is bendable into an arctuate or other curve. Panel 10 may bend either elastically or inelastically (take a set in a particular curved shape).

FIG. 2 shows in more detail, the structure of one preferred embodiment of the invention. Panel 10 comprises a first plurality of bars or segments 12 and a second plurality of bars or segments 22. The second plurality of bars 22 is essentially unitary with and usually orthogonal to the first plurality of bars 12 to form panel 10 as a solid, unitary grid structure having a plurality of the apertures 30. Bars 12 and 22 have essentially identical construction, so the cross sections for bars 12 shown in FIG. 2 depict the cross sections for bars 22 as well.

In this first preferred embodiment, each bar 12 and 22 respectively includes an internal strand 14 or 24 typically formed of steel or other hard, rigid metal, but may also comprise a hard, rigid plastic. The term "strand" in this context means a rod or wire having an axis and a relatively great length along its axis compared to the maximum dimension perpendicular to the axis. Ideally, each strand 14 and 24 is continuous from one edge of panel 10 to the other.

FIG. 1, for ease of understanding, shows only a single one of each of strands 14 and 24. The strands 14 and 24 shown in FIG. 1 have dotted outline form to represent that all except possibly the ends of strands 14 and 24 are internal to bars 12 and 22. Strands 14 and 24 collectively form a frame member 11 that lends structural rigidity to panel 10 and that forms the base or substrate for the coatings that comprise panel 10. Other constructions of the frame member 11 are possible, such as a perforated sheet or plate or, as will be explained in connection with FIG. 5, a grid formed from a number of spaced and typically parallel strands.

Preferably, a frame member 11 in the form of strands 14 and 24 comprises a preformed woven wire or rod mesh supplied as individual sheets or in a roll, which form depending to some extent on the thickness of individual strands 14 and 24. Strands 14 and 24 do not rigidly connect to each other at crossing points, so a frame member 11 comprising such a mesh is easy to deform, that is, has very little internal rigidity. As a woven article, an individual strand crosses sequential strands on opposite sides.

The frame member 11 defines a surface that typically is planar, but need not be so. As will be explained, characteristics of the coatings applied to the frame member may provide the substantial internal rigidity for panel 10. Initially, the woven construction for.

Each of the first plurality of strands 14 crosses each of the second plurality of strands 24 at a crossing point as at 33 in FIG. 2. At each crossing point 33, a bond in the finished panel 10 connects the strands 14 and 24 together in some way to provide substantial internal rigidity for panel 10. "Substantial internal rigidity" in this context means that the strands 14 and 24 forming frame member 11 as well as the coatings applied to them are in the finished panel 10, dimensionally fixed with respect to each other in the plane or other surface of panel 10. Substantial internal rigidity does not preclude forcibly bending panel 10 out of its unstressed shape.

The currently preferred embodiment uses a coating of a bonding material on frame 11 to furnish this bond, but welding or other bonding at crossing points 33 may also provide adequate internal rigidity. A crossing point 33 may include a weldment for example.

A preferred embodiment shown in FIG. 2 has strands 14 that interweave with strands 24 to form a frame member of woven mesh. Such a frame member 11 is analogous to but has smaller dimensions than certain types of woven wire fencing material or reinforcing mesh used in concrete floors. The choice for the spacing and size of strands 14 and 24 provides the desired size of panel apertures 30 and affects the strength and flexibility required for panel 10. Woven frame members 11 are available in rolls or as sheets precut to desired dimensions.

In the preferred embodiment of FIGS. 1 and 2, hard plastic bonding coatings 16 and 27 surround the strands 14 and 24 respectively. The bonding coatings 16 and 27 are coextensive and unitary at the crossing points 33. An outer elastomeric coating or covering 18 encloses bonding coatings 16 and 27 and strands 14 and 24. Bonding coatings 16 and 27 should themselves bond strongly to strands 14 and 24 or to the primer if present.

Proper preparation of metal strands 14 and 24 prior to forming coatings 16 and 27 can improve the bonding strength of coatings 16 and 27 to strands 14 and 24. Preferred preparation of strands 14 and 24 includes first degreasing, with acid etching following. After washing and drying strands 14 and 24, a metal primer is applied by dipping or spraying.

A coating process (painting or spraying) or preferably, a dipping process, applies the hard plastic to strands 14 and 24 as a viscous uncured liquid to form bonding coatings 16 and 27. Coatings 16 and 27 enclose and cover all of the surfaces of strands 14 and 24 except possibly the ends thereof, and most importantly, the surfaces of strands 14 and 24 at and near each crossing point 33. Heat then partially cures the uncured liquid coating to a jelly-like state.

To further improve adhesion between coatings 16 and 27 and ferrous strands 14 and 24, the primer may be of the type that temporarily softens without damage at 300-600° F. Many polyurethane, epoxy, and polyester-based primers are of this type. One particular suitable primer is 2721 Red Primer available from PolyOne Corp., Avon Lake, Ohio 44019

If strands 14 and 24 comprise a hard plastic, preparation may include surface roughening and cleaning.

The preferred type of plastic for bonding coatings 16 and 27 is supplied as a liquid that hardens by heating to a curing temperature substantially above room temperature for an appropriate time. However, two-part polyester and epoxy resins that harden over time at room temperature may also function suitably for this application.

One suitable plastic material for coatings 16 and 27 that heat-cures from a liquid to a hard solid is a synthetic material having a high post-cure durometer value and that adheres well to strands 14 and 24 after curing. Further, the selected plastic material should adhere firmly to the elastomeric outer layer 18 as described in more detail below. Natural types of materials such as latex rubber are also usable in place of synthetic plastic materials formed chemically from petroleum products.

The plastic material comprising coatings 16 and 27 may be a hard rubber or hard urethane when cured, in either case having a durometer value of approximately 40-60. Coating 16 may also comprise a liquid PVC which, when cured, has characteristics similar to hard rubber or hard urethane. PVC is preferable in some circumstances because of its lower cost. Typical plastics that are suitable for coatings 16 and 27 cure completely when held at temperatures in the range of approximately 400 to 650° F. for a period of approximately 2 minutes at higher temperatures to 30 minutes at lower temperatures in the range.

One purpose of coatings 16 and 27 is to firmly bond strands 14 to strands 24 at crossing points 33 to convert the strands 14 and 24 into a frame member 11 having the desired substantial internal rigidity. At the same time, however, coatings 16 and 27 preferably have a small amount of elasticity to allow bending without cracking or peeling. Likely because tensile and shear forces between strands 14 and 24 at crossing points 33 act on very short thicknesses of coating 16 material, the frame member created from the individual strands 14 and 24 has substantial internal rigidity even if coating 16 and 27 material has some elasticity.

Figure 3:
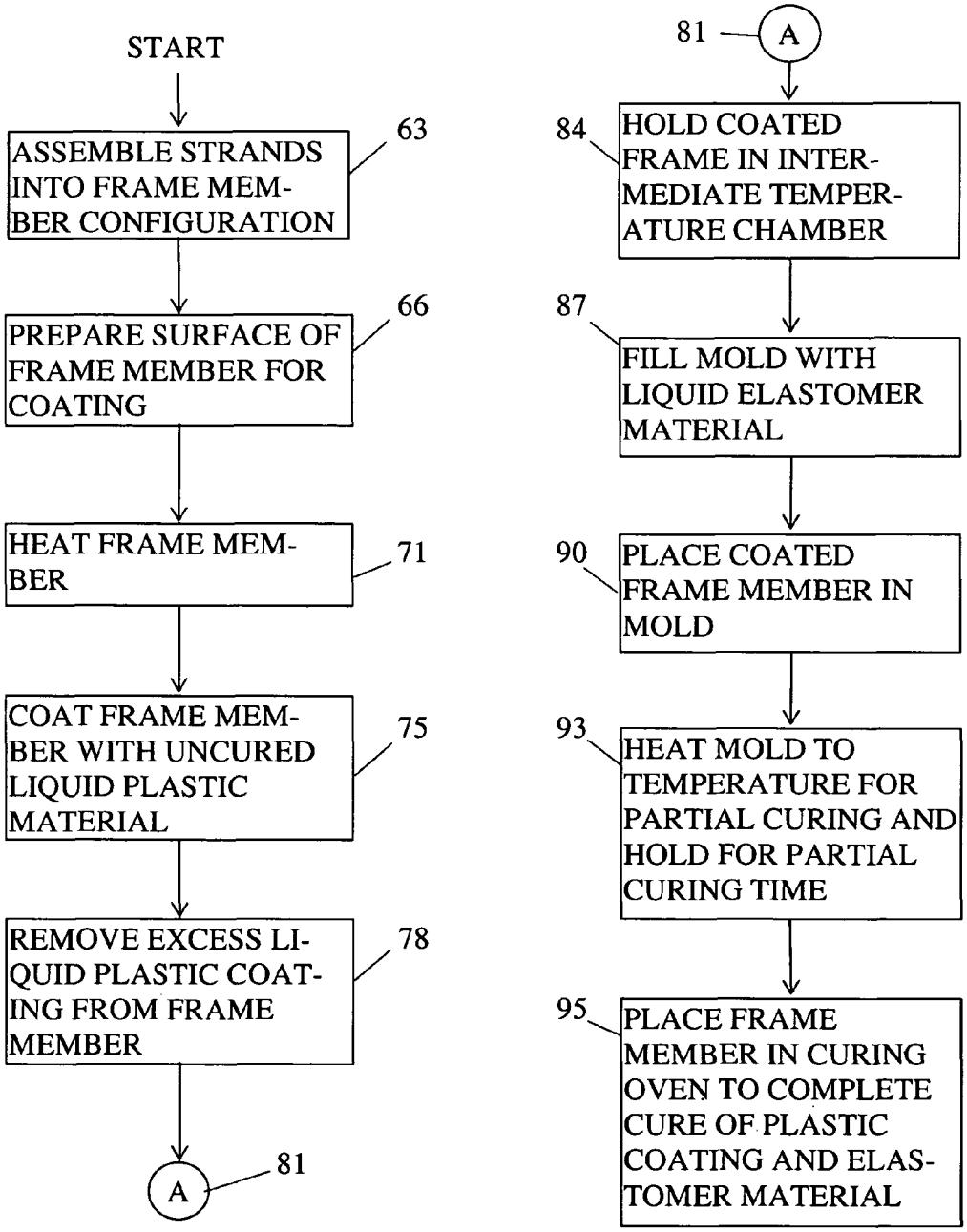
FIG. 3 is a process chart for constructing a preferred embodiment of the invention.

FIG. 3 is a process chart that summarizes the steps for making a preferred panel 10 first has a series of steps for constructing the frame member 11 comprising strands 14 and 24. The process starts with a step 63 of assembling strands 14 and 24 into the desired configuration relative to each other to form the frame member 11. Typically, a frame member 11 is supplied already assembled in the interwoven form shown, so this step is performed by the manufacturer.

If interwoven, friction between and elastic deflection of strands 14 and 24 will usually hold them in the desired crossed grid configuration. A manufacturer may form annular grooves in interwoven strands 14 and 24 that serve to latch the strands together until the bonding coatings 16 and 27 have been applied to strands 14 and 24 to them to each other.

Step 66 then treats the strands 14 and 24 to receive the hard plastic coating. Step 66 may include roughening, acid etching, degreasing, and cleaning the surfaces of strands 14 and 24.

Step 71 heats the assembled strands 14 and 24 to an initial temperature within the approximate range of 350° F. to 650° F. The purpose of the heating step 71 is to provide for partial curing of the bonding coating adjacent to the surfaces of strands 14 and 24, and particularly at crossing points 33. Lower initial temperatures are preferred for thicker strands 14 and 24 since such strands have higher total heat capacity relative to their surface area and thus can maintain for a longer interval, a higher surface temperature for partially curing coatings 16 and 27.

A coating step 75 that applies the uncured liquid plastic to heated strands 14 and 24 occurs next. Currently, dipping the assembled and heated strands in a tank of uncured liquid plastic material is the preferred method, but spraying or brushing is also a possible means of application. If a dipping process applies the liquid plastic, the liquid plastic in the tank is preferably at a temperature in the approximate range of 80° F. to 120° F., which is far below the curing temperature for the liquid plastic.

The relatively high temperature of strands 14 and 24 partially cures the plastic material within a short distance from the surfaces of strands 14 and 24. The result is a layer of partially cured plastic material adhering to strands 14 and 24 that bonds strands 14 and 24 at their crossing points 33. At least the external layer of the partially cured plastic layer on strands 14 and 24 has at this stage a jelly-like consistency.

Next, a step 78 provides for removing from strands 14 and 24 any excess liquid plastic if necessary. If dipping applies the liquid plastic to strands 14 and 24, the excess plastic may be removed by allowing a time for the excess to drip off, or the excess may be shaken or spun off.

Step 84 holds the coated strands 14 and 24 for approximately 1-5 min. in a chamber having an intermediate temperature in the approximate range of 120° F. to 220° F. This choice for the temperature range maintains the polymer to form coatings 16 and 27 in a jelled state without complete reaction and curing. Step 84 causes the polymeric elastomeric outer coating 18 during its formation, to bond more firmly to the partially cured bonding coatings 16 and 27.

Step 87 fills a mold with uncured liquid elastomeric material that is to become elastomeric coating 18. The mold has a grid pattern similar to a waffle iron with grooves whose size, spacing, and orientation match the configuration of the individual strands 14 and 24 forming the frame member 11. It may be necessary to applying a parting coating to the mold surface before adding the elastomeric material to allow the elastomeric material forming the outer coating 18 of panel 10 to separate from the mold without damaging panel 10. The elastomeric material may have a temperature in the approximate range of 75-220° F. when placed in the mold.

The cross sections of the mold's grooves determine the cross sections of elastomeric coating 18 and therefore of bars 12 and 22. When the panel 10 design is for a sorting screen, preferably, bars 12 and 22 have a trapezoidal cross section, but other shapes may also function properly. Trapezoidal cross sections for bars 12 and 22 form sorting screens with apertures having trapezoidal cross sections as well that limit clogging by particles that are only slightly larger than the screen apertures. Arrow 30 in FIG. 1 indicates the direction in which sorted particles flow during use.

Next, a step 90 places the coated frame member in the mold. Supports integral with the mold suspend strands 14 and 24 by the ends of at least a few of the strands 14 and 24 so that the strands are centrally located in the cross sections of the mold's grooves.

Following step 90, a step 93 heats the mold to partially cure the elastomeric material forming coating 18 and to further cure bonding coatings 16 and 27. A typical partial curing heats the mold to within the approximate range of 90-220° F. and holds the temperature for the approximate interval of 10-120 min. The temperature in step 93 and the time in the heated mold preferably are high enough and long enough respectively to partially cure the elastomeric layer 18.

When partially cured, coating 18 has sufficient mechanical integrity to allow without sagging, tearing, or running of coating 18, removing panel 10 from the mold and placing the entire panel 10 in a high temperature chamber to complete curing and bonding between coatings 16 and 27, and layer 18. After removing the heat and allowing the mold and the completed panel 10 to cool, one can remove panel 10 from the mold.

During step 93, a reaction likely takes place at interfacing surface 20 of the jelled but not yet completely cured bonding coatings 16 and 27 and the uncured elastomeric coating 18. This reaction, or perhaps some other mechanism, strongly bonds elastomeric coating 18 to bonding coatings 16 and 27, and may enhance bonding between the frame member and coatings 16 and 27.

After step 93 is complete, the uncured elastomeric coating 18 and the surface of bonding coating 16 and 27 may have viscosity ranges of 1000-3000 centipoises and 5000-25000 centipoises respectively. The viscosity is temperature sensitive, so these ranges are only approximate. The viscosity of coatings 16, 27, and 18 should be high enough to allow handling of frame member 11 without affecting the geometry of the coatings.

A step 95 completes curing of the bonding coatings 16 and 27 and the outer coating 18. This curing step is fastest with infrared heat, but can also use convection. However the heat is applied, the coatings 16, 27, and 18 are held at a temperature in the range of 350-500° F. for approximately 30-120 min. depending on the temperature and the type of materials forming coatings 16, 27, and 18, until they have all cured completely.

As mentioned, the grooves in the mold may have a trapezoidal shape when the bars 12 and 22 are to have the presently preferred trapezoidal shape. However, the grooves in the mold may also have a triangular, square, or rectangular cross-section to produce such types of cross sections for bars 12 and 22.

Although a mold with crossed grooves of the desired cross section is preferred to provide the desired cross sections other manufacturing operations are possible. Such operations include drawing through a special die, or physical rotation of the entire matrix at a speed while concurrently applying a flow of air that impinges upon the framework in order to accomplish formation of the tapered walls. A mold with the desired cross sections for bars 12 and 22 seems to be the most effective at this time.

The entire forming process of making the panel 10 can provide openings 30 whose dimensions have a tolerance of perhaps as small as ±0.001".

While it is preferable to include steps 75, 78, and 84 that form the bonding coatings 16 and 27, in some circumstances not requiring as high a quality as the FIG. 3 process provides, these steps 75, 78, and 84 may be omitted. If omitted, one may expect poorer bonding of coating 18 to strands 14 and 24. This may affect the substantial internal rigidity of such a finished panel 10.

Alternatives exist for the design of the frame member. FIG. 4 for example shows a frame member comprising a pair of zigzag strands 95 arranged so that apices of each are in opposed and adjacent relationship as shown at junctions 98. Bonding coating material applied by dipping or spraying for example, attaches strands 95 to each other at junctions 98.

Reasonable internal rigidity results if the bonding coating is relatively thick. An adequately thick bonding coating stiffens each strand 95 at its apex, where most of the tensile and compressive flexibility in the plane of the frame member occurs. Although this construction is much easier to fabricate than an interwoven frame member, the internal rigidity is less than for the interwoven construction, and may not be adequate for all applications for a panel 10.

Punching or drilling openings in a solid sheet of material is another process for forming the frame member. In this case, the only purpose of the bonding coating is for attaching the elastomeric layer to the frame member. Because a substantial amount of scrap results from punching or drilling openings and because such steps may use a significant amount of machining time, these operations may not be preferred.

FIG. 5 shows another embodiment of a sorting screen in the form of a panel 100 that is adapted for fabrication according to the process shown in FIG. 3. Panel 100 has a frame 109 defining an interior space. Frame 109 comprises a pair of first elongate peripheral members 111 joined at ends thereof to the ends of a pair of second elongate peripheral members 113 that may be shorter than members 111. A plurality of stringers 103 extend across a short dimension of frame 109 between first members 111, attaching at ends thereof to first members 111. Stringers 103 usually are parallel to each other, but need not be. Stringers 103 each carry a plurality of fingers or projections 106 transverse to and spaced along the length of individual stringers 103.

Fingers 106 may extend equal distances transversely from the stringer 103 supporting those fingers 106, or may extend unequal distances from the supporting stringer 103, which is the structure shown in FIG. 5. In any case, ends of at least some individual fingers 106 may be spaced from both adjacent stringers 103 and other adjacent fingers 106. It is possible to have some fingers 106 unitary with adjacent fingers 106 and stringers 103, and other fingers 106 having ends spaced from adjacent fingers 106 and stringers 103.

In one embodiment, fingers 106 are staggered with respect to the fingers 106 of adjacent stringers 103 as shown in FIG. 5. The spaces between the adjacent stringers 103 and fingers 106 define apertures useful for sorting particulate masses of varying particle sizes according to size.

The formation of frame 109, individual stringers 103, and fingers 106 is preferably according to the process steps of FIG. 3. Frame 109 and stringers 103 each preferably include internal wires, rods, or plates (elongate members) to provide suitable strength and stiffness. A layer of elastomeric material formed according to the process steps of FIG. 3 encapsulates at least portions of the stringers 103, and preferably all of the surfaces of the stringers 103.

Fingers 106 preferably are formed by molding to be unitary with the elastomeric layer on the individual stringers 103 and preferably comprise elastomeric material only. Fingers 106 rely on the mechanical strength and stiffness of the elastomeric material covering stringers 103 and forming fingers 106 to oppose forces from particles pressing against fingers 106 while sifting or sorting these particles by size. Because there are no crossing strands attached to stringers 103, stringers 103 may need to be made of heavier stock to resist bending in response to these sorting forces.

Figure 6:
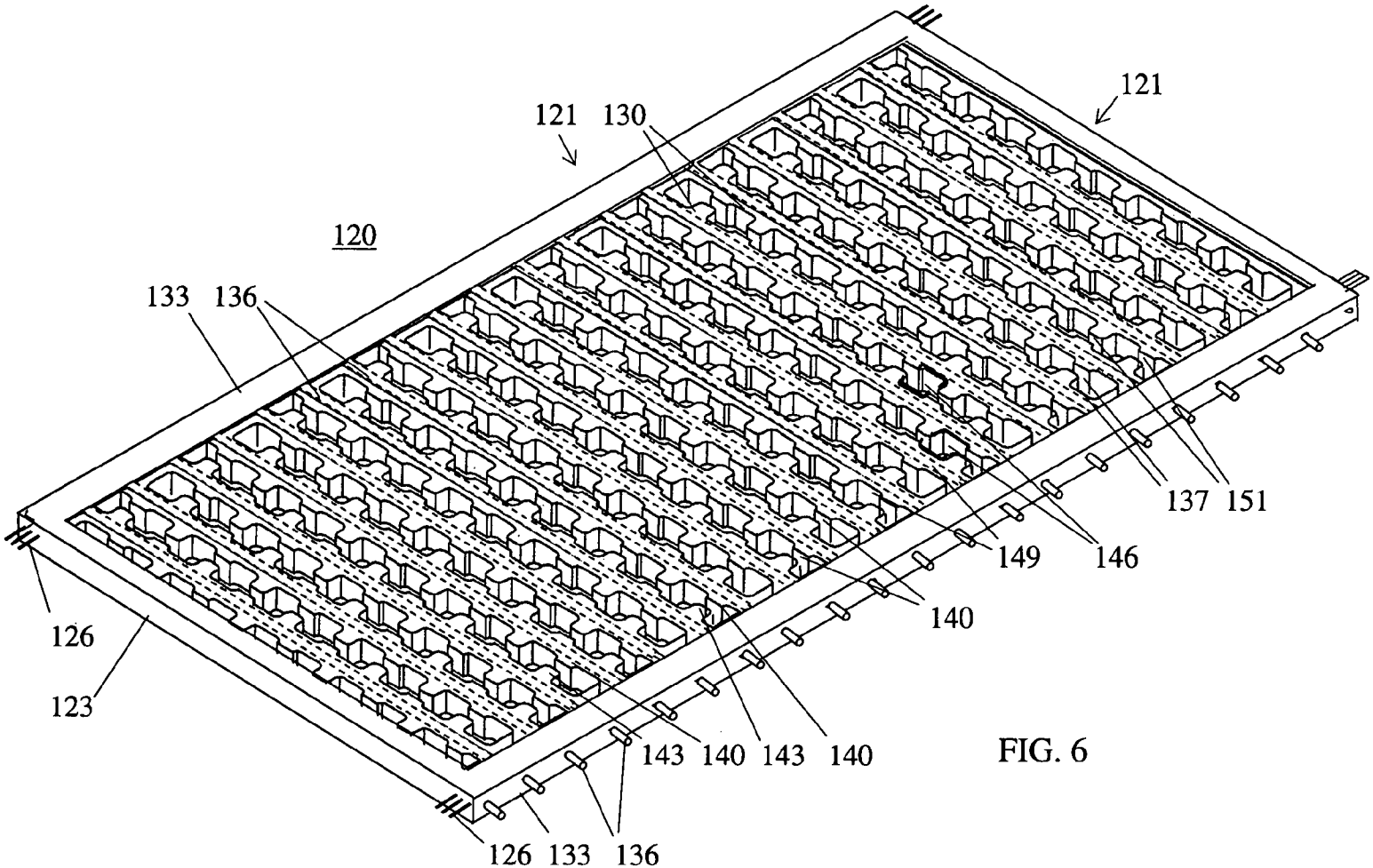
FIG. 6 shows a third alternative construction for the panel.

FIG. 6 shows another embodiment of the invention made possible by the structure that the process above creates. Panel 120 includes a frame 121 comprising side walls 133, end walls 123, and strands 136. Side walls 133 and end walls 123 are fastened to or unitary with each other and support the strands 136. Side walls 133 may include internal strands or stiffeners 126. Walls 123 and 133 may generally define a plane. Wall 123 and 133 may be formed according to the process that FIG. 3 describes.

Side walls 133 support strands 136 to define a grid-like structure comprising a substrate for the material forming a series of evenly spaced, stringers 130. Each stringer 130 has at least one side 137 facing a side 137 of an adjacent stringer 130. The process described in FIG. 3 is useful to form stringers 130. Strands 136 provide stiffening for stringers 130. Stringers 130 may be unitary with side walls 133 and formed during the formation of side walls 133, all using the FIG. 3 process.

In the particular embodiment of FIG. 6, each individual stringer 130 has surfaces 137 with a particular structure. Each surface 137 has alternating short projections 140 and long projections 143 defining between each adjacent pair of projections 140 and 143 a recess or slot. Each short projection 140 is in alignment with a long projection 143 on an adjacent side wall 137. On each side wall 137, each short projection 140 defines with an adjacent long projection 143, a recess forming one half of a slotted-wall sorting aperture 146. Because of the alignment of projections 140 and 143 on adjacent side walls 137, a pair of recesses on adjacent side walls 137 that are in facing alignment with each other define one slotted-wall aperture 146.

FIG. 6 shows representative apertures 146 with bold-lined upper edges to better disclose these apertures 146. The two edge (as opposed to end) walls of each pair of adjacent projections 140 and 143 define two sides of a U-shaped channel or recess defining one half of a slotted-wall sorting aperture 146. Together, two U-shaped recesses form a single slotted-wall aperture 146. The end walls of two facing projections 140 and 143 carried on two adjacent and facing side walls 137 define between them a single slot 151 of one aperture 146. Each aperture 146 has two slots 151 defined by the end walls of two adjacent projections 140 and 143 on a first side wall 137 in facing relation to a second side wall 137 having projections 140 and 143 that are respectively facing the two adjacent projections 143 and 140 on first side wall 137.

Other configurations are possible for projections 140 and 143. For example, projections 140 and 143 may all have the same length. Or all of the projections along one side of a stringer 130 may be short compared to the projections on the facing side or an adjacent stringer 130.

The reader should understand that this disclosure, in many respects, is only illustrative. Changes in details, particularly in matters of shape, size, material, and arrangement of parts are within the scope of the invention. Accordingly, the scope of the invention is as defined in the language of the appended claims.

The claimed subject matter is:

1. A panel of the type having a plurality of spaced apart apertures, comprising:

a) a substantially planar frame member having a plurality of openings therein larger than the apertures, said frame member having substantial internal rigidity, and wherein the frame member comprises a first plurality of strands and a second plurality of strands crossing the first plurality of strands to form a matrix with each strand of the first plurality of strands crossing and closely adjacent to each strand of the second plurality of strands at a crossing point, wherein a pair of adjacent strands of the first plurality in cooperation with a pair of adjacent strands of the second plurality define an opening;

b) elastomeric material forming a coating encapsulating at least a portion of said frame member; and c) a bonding coating between and securely bonding to both of the elastomeric coating and the frame member.

2. The panel of claim 1, wherein the bonding coat comprises a primer coat on the frame member and a hard plastic middle layer on the primer coat, each coat strongly adhering to each adjacent coat.

3. The panel of claim 1, wherein the bond at the crossing points comprises a weldment.

4. The panel of claim 1, wherein the bonding coating between the strands and the elastomeric coating furnishes each crossing point bond, said bonding coating rigidly fastening each pair of strands at a crossing point to each other.

5. The panel of claim 4, wherein the bonding coating comprises a high durometer, rigid, polymeric material firmly bonded to the first and second plurality of strands.

6. The panel of claim 5, wherein the polymeric material encapsulates a predetermined length of each of the first and second pluralities of strands, and bonds together each pair of strands at each crossing point.

7. The panel of claim 4 adapted for sorting a mass of particles by size, wherein said panel's elastomeric coating has a contact face forming a side of the panel, said face intersected by the apertures and against which particles are to be placed for sorting, wherein portions of the elastomeric coating extend into and define the walls of the apertures.

8. The panel of claim 7, wherein the portions of the elastomeric coating defining an aperture have surfaces defining the aperture that approximate the shape of a frustum, each frustum having a larger end and a smaller end, with the smaller end of each frustum aligned with the contact surface.

9. The panel of claim 4, wherein the bonding coat comprises a primer coat on the frame member and a hard plastic middle layer on the primer coat, each coat strongly adhering to each adjacent coat.

10. The panel of claim 1 wherein the first plurality of strands interweave with the second plurality of strands.

11. The panel of claim 10 wherein the first plurality of strands are approximately perpendicular to the second plurality of strands.

12. The panel of claim 1, wherein the strands comprising the frame member are centrally positioned within the bonding coating and the elastomeric coating, and the bonding coating and the elastomeric coating collectively have sufficient flexibility to allow bending into an arcuate curve.

13. The panel of claim 12 wherein the panel has first and second surfaces, and the first plurality of strands and the second plurality of strands are all substantially equidistant from the first and second surfaces within the elastomeric material, and furthermore, wherein the cross section of the elastomeric material is substantially symmetrical.

14. The panel of claim 1 adapted for sorting particles by size, wherein said panel's elastomeric coating has a contact face extending across a surface of the frame member and which the apertures intersect, and against which particles are to be placed for sorting, wherein portions of the elastomeric coating extend into and define the walls of the apertures.

15. The panel of claim 1, wherein the elastomeric material is a cured elastomer.

* * * * *